United States Patent [19]

Satoh et al.

[11] 4,279,712

[45] Jul. 21, 1981

[54] METHOD FOR ELECTROLYZING HYDROCHLORIC ACID

[75] Inventors: Hitoshi Satoh, Kashiwa; Shohei Kosaka, Yokohama, both of Japan

[73] Assignee: Chlorine Engineers Corporation, Ltd., Tokyo, Japan

[21] Appl. No.: 117,930

[22] Filed: Feb. 4, 1980

[30] Foreign Application Priority Data

Feb. 2, 1979 [JP] Japan ..... 54-10313

[51] Int. Cl.[3] ..... C25B 1/26; C25B 1/02

[52] U.S. Cl. ..... 204/128; 204/129

[58] Field of Search ..... 204/128, 129

[56] References Cited

U.S. PATENT DOCUMENTS 4,057,474 11/1977 Kurtz et al. ..... 204/98

*Primary Examiner*—R. L. Andrews

*Attorney, Agent, or Firm*—Sughrue, Rothwell, Mion, Zinn and Macpeak

[57] ABSTRACT

In a method for electrolyzing hydrochloric acid in an electrolysis apparatus, the improvement which comprises the electrolysis apparatus comprising at least two electrolysis cells, each electrolysis cell having at least one anode, at least one cathode and at least one cation exchange membrane therebetween to define an anode compartment and a cathode compartment therein, and the method comprising the steps of (a) feeding hydrochloric acid aqueous solution as a starting material into the anode compartment of a first electrolysis cell and electrolyzing the hydrochloric acid aqueous solution therein, (b) feeding hydrochloric acid aqueous solution discharged from the anode compartment of the first electrolysis cell into the anode compartment of a second electrolysis cell and electrolyzing the hydrochloric acid aqueous solution therein, (c) feeding hydrochloric acid aqueous solution discharged from the anode compartment of the last electrolysis cell of the electrolysis apparatus into the cathode compartment of each of the electrolysis cells in the electrolysis apparatus, (d) and further, for any additional electrolysis cells present in addition to the first and the second electrolysis cells, subsequent to step (b) and prior to step (c), sequentially feeding hydrochloric acid aqueous solution discharged from the anode compartment of a preceding electrolysis cell into the anode compartment of a subsequent electrolysis cell and electrolyzing the hydrochloric acid aqueous solution therein and (e) collecting chlorine gas generated in the anode compartments and hydrogen gas generated in the cathode compartments.

3 Claims, 4 Drawing Figures

METHOD FOR ELECTROLYZING HYDROCHLORIC ACID

BACKGROUND OF THE INVENTION

1. Field of the Invention

This invention relates to a method for electrolyzing hydrochloric acid for the formation of chlorine, and specifically, provides a method for electrolyzing hydrochloric acid, in which the electrolyzing voltage is low, the current efficiency is high and the ratio of utilization of hydrochloric acid as a raw material is high, and which is not likely to pose a problem of pollution by the waste material discharged.

2. Description of the Prior Art

Chlorine is widely used for water treatment in sterilizing or disinfecting tap water, sewage, industrial and household effluents and water used for various types of particular purposes, and for oxidizing or bleaching treatments of various substances. Chlorine is also used in the chlorination of organic compounds. Transportation of chlorine in gas bombs is dangerous, however. In particular, when it is desired to use a large quantity of chlorine gas continuously, the danger of handling and storage of chlorine gas is the greatest problem in using chlorine gas.

For this reason, a chlorine-generating apparatus at a site adjacent a water treatment facility so that the generated chlorine can be used in situ is desirable.

Electrolysis of hydrochloric acid at a site adjacent a water treatment facility may be feasible as one particular means of achieving this. At this time, it is desirable to produce chlorine economically by minimizing the electrolyzing voltage for hydrochloric acid, maintaining the current efficiency high and utilizing the starting hydrochloric acid effectively, and to prevent pollution by the waste material discharged.

When dilute hydrochloric acid after the termination of electrolysis is to be discarded after neutralization with alkali, it is necessary for the hydrochloric acid after the termination of electrolysis to have the lowest possible concentration and to be present in a small amount from an economic standpoint. However, when hydrochloric acid is electrolyzed until the concentration of hydrochloric acid becomes very low, the electrolyzing voltage becomes high, and the current efficiency is decreased due to the generation of oxygen. Thus, the concentration of hydrochloric acid should be maintained at a point above a certain limit. Thus, it has been difficult to obtain chlorine economically using conventional methods of electrolyzing hydrochloric acid.

As a method for reducing the electrolyzing voltage positively, addition of various metal salts to the electrolytic solution has been suggested (for example, as disclosed in Japanese Patent Publications Nos. 26606/70, and 27514/74). However, this method has the disadvantage that additional expenses are involved in the treatment of waste liquors for control of pollution.

A method which involves bubbling hydrogen chloride gas into hydrochloric acid of a low concentration after the electrolysis has also been suggested. However, since hydrogen chloride gas is used as a material in this method, hydrogen chloride gas under high pressure must be transported and stored, and a problem of safety arises.

SUMMARY OF THE INVENTION

An object of this invention is therefore to provide a method for electrolyzing hydrochloric acid, which can be used to produce chlorine by electrolyzing hydrochloric acid to a low concentration at a low electrolyzing voltage and a high current efficiency, and which involves no additional expense for pollution control.

Another object of this invention is to recover chlorine in good efficiency by electrolyzing hydrochloric acid which is a by-product in the chlorination process of organic compounds, and to circulate the chlorine to the chlorination process.

Accordingly, this invention provides a method for electrolyzing hydrochloric acid in an electrolysis apparatus, with the electrolysis apparatus comprising at least two electrolysis cells, each electrolysis cell having at least one anode, at least one cathode and at least one cationic exchange membrane therebetween to define an anode compartment and a cathode compartment therein and with the method comprising the steps of (a) feeding hydrochloric acid aqueous solution as a starting material into the anode compartment of a first electrolysis cell and electrolyzing the hydrochloric acid aqueous solution therein, (b) feeding hydrochloric acid aqueous solution discharged from the anode compartment of the first electrolysis cell into the anode compartment of a second electrolysis cell and electrolyzing the hydrochloric acid aqueous solution therein, (c) feeding hydrochloric acid aqueous solution discharged from the anode compartment of the last electrolysis cell of the electrolysis apparatus into the cathode compartment of each of the electrolysis cells in the electrolysis apparatus, (d) and further, for any additional electrolysis cells present in addition to the first and the second electrolysis cells, subsequent to step (b) and prior to step (c), sequentially feeding hydrochloric acid aqueous solution discharged from the anode compartment of a preceding electrolysis cell into the anode compartment of a subsequent electrolysis cell and electrolyzing the hydrochloric acid aqueous solution therein and (e) collecting chlorine gas generated in the anode compartments and hydrogen gas generated in the cathode compartments.

BRIEF DESCRIPTION OF THE ACCOMPANYING DRAWINGS

DETAILED DESCRIPTION OF THE INVENTION

The invention is described in greater detail below with reference to the accompanying drawings.

Figure 1:
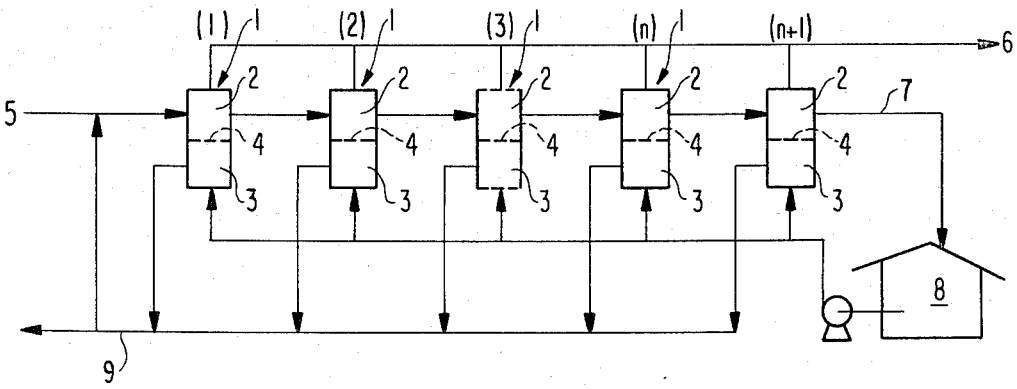
FIG. 1 shows one embodiment of the electrolyzing method of this invention.

Referring to FIG. 1, two or more electrolysis cells 1 are provided. Each electrolysis cell 1 has at least one anode and at least one cathode (not shown) therein, and each electrolysis cell 1 is partitioned into an anode compartment 2 and a cathode compartment 3 by at least one cation exchange membrane 4. An aqueous solution of hydrochloric acid 5 as a starting material is fed into the anode compartment of the first electrolysis cell (1), and electrolyzed. Then, the aqueous solution of hydrochloric acid discharged from the anode compartment 2 is fed into the anode compartment 2 of the second electrolysis cell (2). Likewise, the aqueous solution of hydrochloric acid discharged from each of the second to the ($n^{th}$) electrolysis cells is successively fed into the anode compartment 2 of the next electrolysis cell. Chlorine gas 6 is generated from the anode compartment of each electrolysis cell 1 by the oxidation of chlorine ion. As the aqueous solution hydrochloric acid moves from the anode compartment 2 of the first electrolysis cell (1) to the anode compartment 2 of the last ($n+1^{th}$) electrolysis cell, the amount of the chlorine ion gradually decreses with the evolution of chlorine gas. However, hydrogen ions in each anode compartment 2 in each electrolysis cell migrate to the cathode compartment 3 of that cell through the cation exchange membrane 4 of that cell, and at this time, water molecules are entrained. Hence, the reduction of the concentration of the hydrochloric acid can be prevented to some extent.

Desirably, at the beginning of the electrolysis, hydrochloric acid is placed in the cathode compartments 3 in advance. In the cathode compartments 3, the hydrogen ions are reduced and hydrogen is generated.

Hydrochloric acid 7 of a low concentration discharged from the anode compartment of the last ($n+1^{th}$) cell is collected at a reservoir 8, and then simultaneously divided and fed into the cathode compartments 3 of each of the electrolysis cells 1 by means of pumps. Hydrochloric acid 9 of a low concentration discharged from each of the cathode compartments 3 is partly used to dilute concentrated hydrochloric acid for the preparation of the starting hydrochloric acid 5. The remainder is neutralized or otherwise treated, and then discarded. It is also possible to recycle the low concentration hydrochloric acid 9 discharged from the cathode compartments 3 to the reservoir 8, neutralize the low-concentration hydrochloric acid discharged from the reservoir 8, and then discard it.

Figure 2:
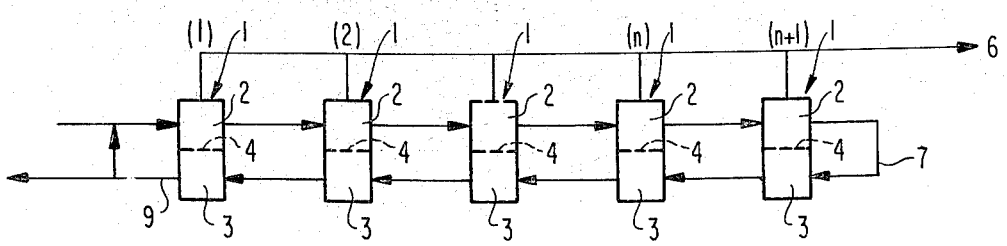
FIG. 2 shows another embodiment of the electrolyzing method of this invention.

In the embodiment shown in FIG. 2, the hydrochloric acid 7 of a low concentration discharged from the anode compartment 2 of the last electrolysis cell ($n+1^{th}$) is first fed into the cathode compartment 3 of the last electrolysis cell. Then, the hydrochloric acid of a low concentration discharged from this cathode compartment 3 is fed into the cathode compartment 3 of the preceding electrolysis cell ($n^{th}$). Likewise, the hydrochloric acid of a low concentration discharged from the cathode compartment 3 of the preceding eletrolysis cell. Finally, the hydrochloric acid 9 of a low concentration is withdrawn from the cathode compartment 3 of the first electrolysis cell 1. A part of it is used for diluting concentrated hydrochloric acid to form the starting hydrochloric acid, and the remainder is neutralized or otherwise treated and then discarded.

An apparatus for practicing the method of this invention may comprise a plurality of unit electrolysis cells each of which is divided into an anode compartment and a cathode compartment by a cation exchange membrane, or may be of a filter press type.

One preferred example is an apparatus including a housing, partition plates dividing the housing into a plurality of unit electrolysis cells, and a plurality of anode compartment units each provided in each of the unit electrolysis cells, each of the anode compartment units comprising a box-type anode structure having an anode acting surface, a cation exchange membrane fitted to the outside surface of the anode acting surface and a cathode plate secured to the outside of the cation exchange membrane, thereby forming an anode compartment inside of each of the box-type anode structures and a cathode compartment outside of the anode compartment unit. This apparatus further comprises a feed opening for feeding a starting aqueous solution of hydrocloric acid into one of the unit anode compartments, a pipe for feeding the electrolyzed aqueous hydrochloric acid solution discharged from the unit anode compartment into another unit anode compartment, and pipes for similarly feeding the electrolyzed aqueous hydrochloric acid solution from the individual unit anode compartments successively into other new unit anode compartments, and a pipe for feeding the electrolyzed aqueous hydrochloric acid solution of low concentration discharged from the last unit anode compartment into the cathode compartment.

Figure 3:
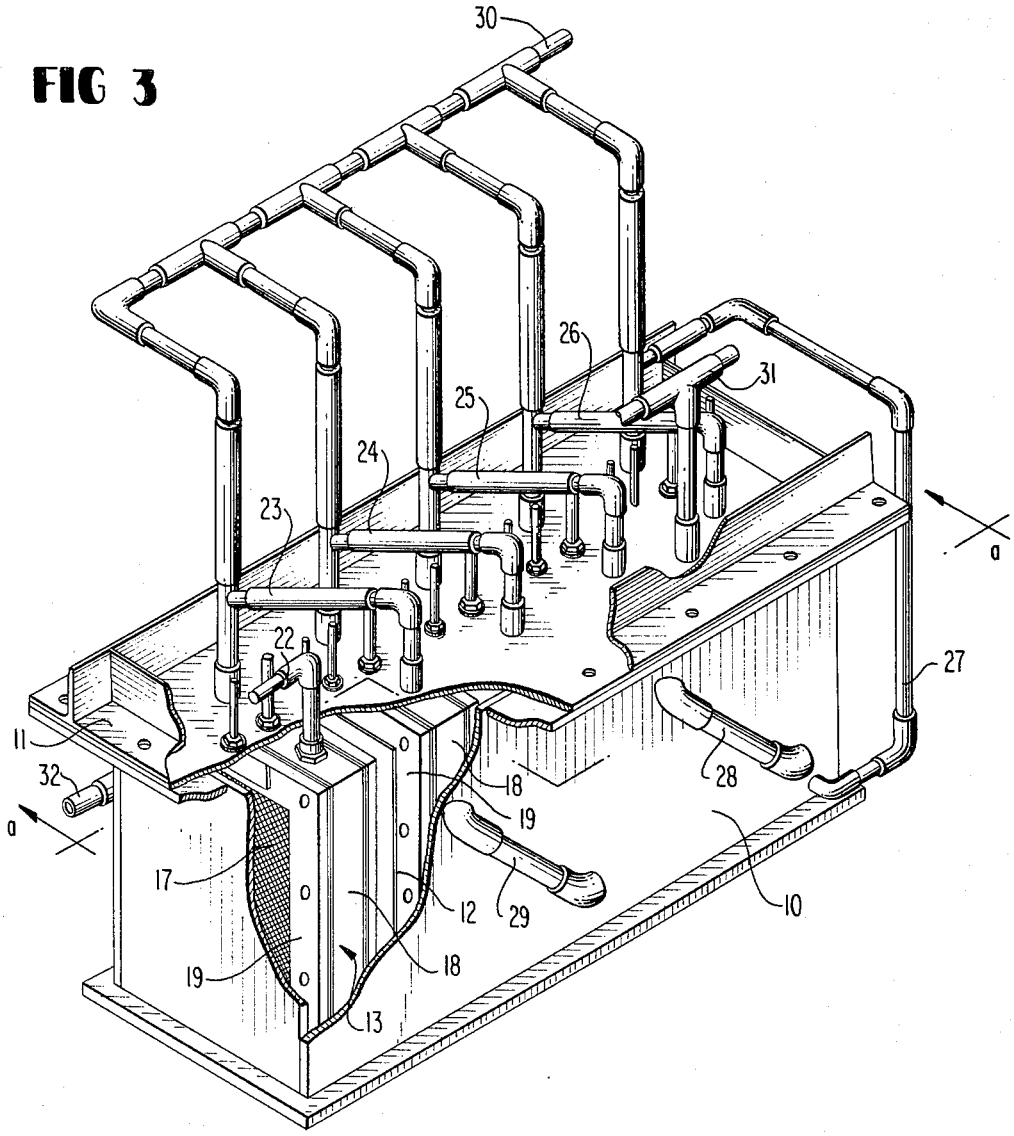
FIG. 3 is a partly broken-away perspective view of the apparatus of this invention.

This apparatus is described with reference to FIGS. 3 and 4. FIG. 3 is a partly broken-away perspective view of the apparatus of this invention, and FIG. 4 is a sectional view taken along the line a—a of FIG. 3.

Figure 4:
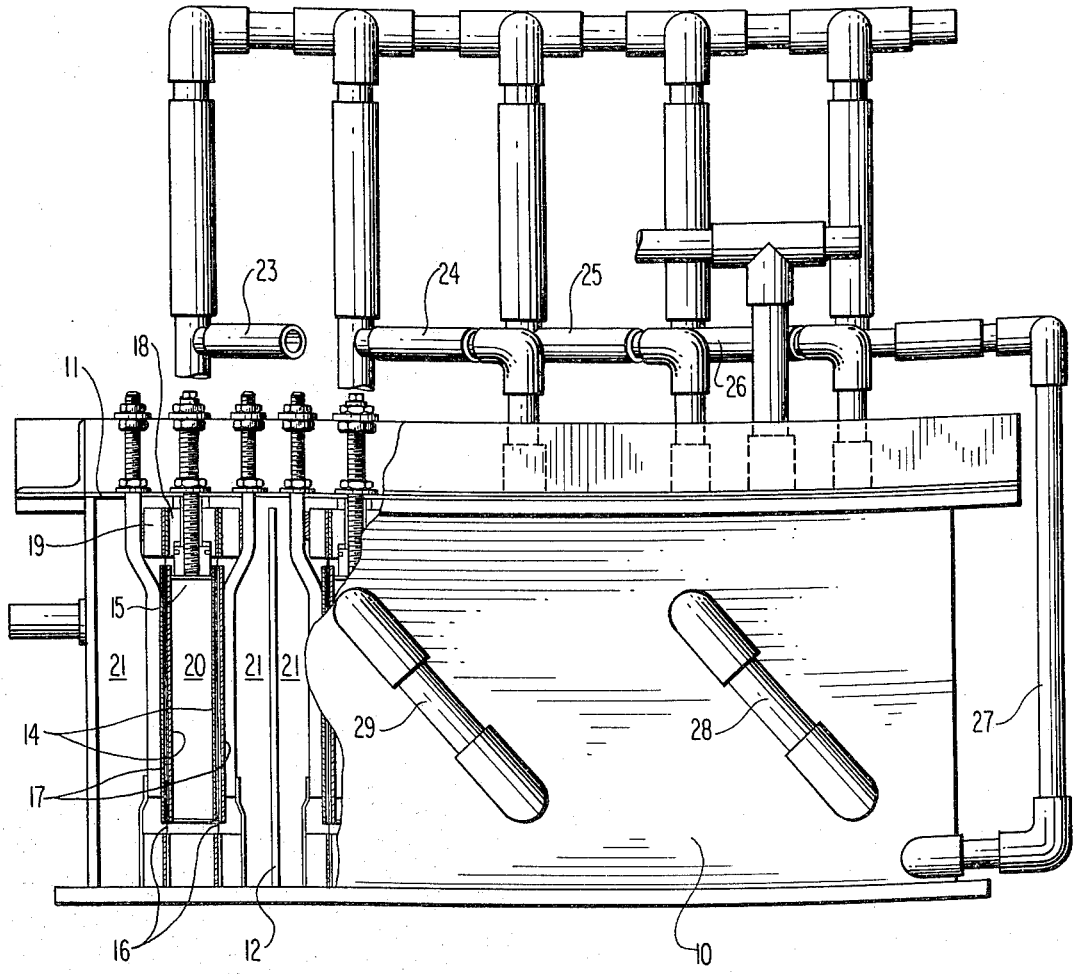
FIG. 4 is a sectional view taken along the line a—a of FIG. 3.

In FIGS. 3 and 4, reference numeral 10 represents a housing of the electrolyzing apparatus; 11, a closure plate of the electrolysis apparatus. The inside of the housing 10 is divided by partitioning plates 12 into five unit electrolysis cells, and an anode compartment unit 13 is provided in each unit electrolysis cell. Each anode compartment unit 13 is made up of a box-type anode structure 15 having an anode acting surface 14, a cation exchange membrane 16 fitted to the outside surface of the anode structure 15, and a cathode plate 17 secured to the outside of the cation exchange membrane 16. The anode acting surface 14 is fixed to a frame 18, and the cathode plate 17 is fixed to a frame 19. The anode acting surface 14 and the cathode plate 17 are made of a net-like plate or porous plate. The cation exchange membrane 16 is held by the frame 18 for the anode and the frame 19 for the cathode. An anode compartment 20 is formed inside of each of the anode structures partitioned by the cation exchange membranes, and a cathode compartment 21 is formed outside of each anode compartment unit.

A feed opening 22 is provided for feeding a starting aqueous solution of hydrochloric acid into one unit anode compartment. Furthermore, the apparatus includes a pipe 23 for feeding the electrolyzed aqueous hydrochloric acid solution discharged from the above described unit anode compartment into another unit anode compartment, and pipes 24, 25 and 26 for similarly feeding the electrolyzed aqueous hydrochloric acid solution discharged from the individual unit anode compartment successively into other new unit anode compartments. A pipe 27 for feeding the electrolyzed aqueous hydrochloric acid solution of low concentration discharged from the unit anode compartment of the fifth, i.e., last, unit cell into the cathode compartment in the same unit cell is provided between the unit anode compartment and the cathode compartment in the fifth unit cell. Pipes are provided for feeding an aqueous hydrochloric acid solution of low concentration as a catholyte from the cathode compartment of the fifth unit cell successively into the cathode compartments of the preceding unit cells. A pipe 28 from the cathode compartment of the fifth unit cell to the cathode compartment in the fourth unit cell and a pipe 29 from the cathode compartment of the third unit cell to the cathode compartment of the second unit cell are provided on one side surface of the housing of the electrolysis apparatus. A pipe from the cathode compartment of the fourth unit cell to the cathode compartment of the third unit cell and a pipe from the cathode compartment of the second unit cell to the cathode compartment of the first unit cell are provided on the opposite side surface of the housing, and are not shown in the drawings.

Each anode compartment is provided with an outlet 30 for chlorine gas generated therein, and each cathode compartment is provided with an outlet 31 for hydrogen gas generated therein, and a pipe 32 for withdrawing the catholyte solution.

Strongly acidic cation-exchange membranes containing a sulfo group can be used as the cation exchange membrane in the present invention.

A specific example of a strongly acidic cation-exchange membrane containing sulfonic acid groups which can be used is, for example, one prepared by hydrolyzing a copolymer comprising tetrafluoroethylene and perfluoro (3, 6-dioxa-4-methyl-1-octenesulfoynlfluoride) with an alkali metal hydroxide to covert to sulfonic acid groups. A typical commercially available membrane of this type is Nafion (a trademark for a product of the E. I. Du Pont de Nemours & Co.) having the general formula:

$$\left(CF_2-CF_2\right)_m\left(CF_2-\underset{\substack{|\\ OCF_2CF-OCF_2CF_2-SO_3^-H^+\\ |\\ CF_3}}{CF}\right)_n$$

A cation exchange membrane using a fluorocarbon resin as a substrate inert to the components contained in the hydrochloric acid aqueous solution is preferred since it is resistant to chemical attack, chemically stable, thermally stable and oxidation resistant.

The anode may be made of, for example, titanium or a titanium alloy coated with a layer containing an oxide of a platinum-group metal, such as ruthenium oxide, rhodium oxide, palladium oxide, osmium oxide, iridium oxide, platinum oxide, and mixtures of each of the oxides and a film-forming (valve) metal oxide such as an oxide of titanium, tantalum or niobium, or graphite. The cathode may be made of, for example, a material such as titanium, tantalum, niobium, zirconium, titanium alloys, such as titanium-palladium, etc., stainless steel, resistant to hydrochloric acid, nickel alloys such as Monel (i.e., a nickel-copper alloy), etc., or graphite.

The concentration of the starting hydrochloric acid (aqueous solution of hydrogen chloride gas) to be fed into the anode compartment of the first electrolysis cell is not particularly limited. In general suitable concentrations which can be used are concentrations of about 5 to about 33% by weight. However, to reduce dissipation by evaporation of hydrochloric acid and the resistance of the liquid, it is preferred for the concentration of the hydrochloric acid to be in the range of about 15 to about 25% by weight. Hydrochloric acid of a suitable concentration can be obtained by diluting commercially available concentrated hydrochloric acid, e.g., with water. It is economical to use hydrochloric acid of a low concentration discharged from the cathode compartments for dilution, because the undecomposed hydrochloric acid can be effectively utilized. While the concentration of the hydrochloric acid discharged will vary depending on the number of anode compartment and cathode compartment stages in the apparatus, in general, the discharge concentration will be about 1 to about 5% by weight more generally about 2 to about 3% by weight from the last anode compartment and about 0.5 to about 4.5% by weight, more generally about 1.5 to 2.5% by weight, from the cathode compartment.

While not to be considered limiting, suitable conditions under which the process described herein can be conducted are set forth below:

Temperature: about 15°–70° C., preferably about 50°–60° C.

Voltage: about 2.2–4.5 V, preferably about 2.2–2.8 V (DC)

Current Density: about 5–50 A/dm$^2$, preferably around 30 A/dm$^2$.

Current Concentration: about 7–45 A.hr/l, preferably about 20–30 A.hr/l.

According to this invention, each of the electrolysis cells is divided into an anode compartment and a cathode compartment by means of a cation exchange membrane. Thus, hydrogen ions migrate into the cathode compartment through the cation exchange membrane, and water molecules are entrained at this time. As a result, the amount of water in the anode compartment decreases correspondingly to prevent a decrease in the concentration of hydrochloric acid in the anode compartment. When only one electrolysis cell is provided, the current efficiency will become very low if hydrochloric acid is electrolyzed until the hydrochloric acid concentration becomes low. However, by providing at least two, preferably at least three, electrolysis cells and continuously performing electrolysis while decreasing the decomposition ratio of hydrochloric acid in each electrolysis cell, the current efficiency can be maintained high, and chlorine can be produced economically.

Generally, the decrease in the concentration of hydrochloric acid causes a reduction in current efficiency and an increase in electrolyzing voltage. However, according to this invention, by the relative increase in the concentration of hydrochloric acid with a decrease in water in the anolyte solution, the starting hydrochloric acid can be utilized effectively while maintaining the current efficiency high and the electrolyzing voltage low.

Furthermore, since hydrochloric acid of a low concentration discharged from the anode compartment of the last electrolysis cell is fed into the cathode compartments of the electrolysis cells, hydrochloric acid of a low concentration which is to be subsequently discarded can be effectively utilized as an electrically conductive catholyte solution. Hydrochloric acid discharged from the anode compartment contains $ClO^-$ ions, these ions are reduced to $Cl^-$ ions by a cathodic reduction reaction, and their concentration decreases. Thus, the amount of expensive reducing agent can be reduced which is economically advantageous.

Chlorine produced by the method of this invention can be used for water treatment, chlorination of organic compounds and so on. When the chlorine is used in the synthesis of organic compounds, the hydrogen generated in the cathode compartment can be used for hydrogenation of organic compounds.

The following Examples are given to more specifically illustrate the present invention. Unless otherwise indicated herein, all parts, percentages, ratios and the like are by weight.

EXAMPLE 1

In accordance with the process shown in FIG. 1, five electrolysis cells were employed, and hydrochloric acid was electrolyzed under the following electrolyzing conditions using an anode composed of titanium having a coating containing an oxide of a platinum-group metal, a cathode composed of a titanium-palladium alloy and Nafion 315 (a trademark for a product of E. I. du Pont de Nemours & Co.; converted to —$SO_3H$) as a cation exchange membrane.

Concentration of Starting Hydrochloric Acid: 20% by weight

Amount of Starting Hydrochloric Acid Fed: 2194 g/hr

Current: 60 A

Current Density: 30 A/dm$^2$

Temperature of the Electrolytic Solution: 70°-80° C.

Electrolysis Time: 500 hours

The flow rate and concentration of the hydrochloric acid at the inlet and outlet of the anode compartment of each electrolysis cell and the voltage (DC) of each cell were determined, and the results are shown in Table 1 below.

TABLE 1

| | Electrolysis Cell | | | | |
|---|---|---|---|---|---|
| | 1st Cell | 2nd Cell | 3rd Cell | 4th Cell | 5th Cell |
| Flow Rate of Hydrochloric Acid (g/hr) | | | | | |
| Inlet | 2194 | 2108 | 2022 | 1918 | 1766 |
| Outlet | 2108 | 2022 | 1918 | 1766 | 1560 |
| Concentration of Hydrochloric Acid (% by weight) | | | | | |
| Inlet | 20.0 | 17.0 | 13.7 | 10.1 | 6.4 |
| Outlet | 17.0 | 13.7 | 10.1 | 6.4 | 2.0 |
| Cell Voltage (V) | 3.0 | 3.0 | 3.0 | 3.1 | 3.5 |

The concentration of hydrochloric acid discharged from the cathode compartment was 1.6% by weight.

The ratio of utilization of the starting hydrochloric acid was 92.9%, and the current efficiency based on the amount of chlorine gas obtained was 93%.

EXAMPLE 2

In accordance with the process shown in FIG. 2, hydrochloric acid was electrolyzed under the following electrolysis conditions using the same type of anode, cathode, and cation exchange membrane as described in Example 1.

Concentration of Starting Hydrochloric Acid: 20% by weight

Amount of Starting Hydrochloric Acid Fed: 5560 g/hr

Current: 150 A

Current Density: 20 A/dm$^2$

Temperature of Electrolytic Solution: 50° C.

Electrolysis Time: 750 hours

The flow rate and concentration of hydrochloric acid at the inlet and outlet of the anode compartment of each electrolysis cell and the voltage of each cell were determined, and the results are shown in Table 2 below.

TABLE 2

| | Electrolysis Cell | | | | |
|---|---|---|---|---|---|
| | 1st Cell | 2nd Cell | 3rd Cell | 4th Cell | 5th Cell |
| Flow Rate of Hydrochloric Acid (g/hr) | | | | | |
| Inlet | 5560 | 5340 | 5120 | 4870 | 4490 |

TABLE 2-continued

| | Electrolysis Cell | | | | |
|---|---|---|---|---|---|
| | 1st Cell | 2nd Cell | 3rd Cell | 4th Cell | 5th Cell |
| Outlet | 5340 | 5120 | 4870 | 4490 | 3970 |
| Concentration of Hydrochloric Acid (% by weight) | | | | | |
| Inlet | 20.0 | 17.0 | 13.7 | 10.3 | 6.6 |
| Outlet | 17.0 | 13.7 | 10.3 | 6.6 | 2.3 |
| Cell Voltage (V) | 3.0 | 3.0 | 3.0 | 3.2 | 3.6 |

The concentration of the hydrochloric acid discharged from the cathode compartment was 2.1% by weight. The ratio of utilization of the starting hydrochloric acid was 91.7%. The current efficiency based on the amount of chlorine gas obtained was 94%.

While the invention has been described in detail and with reference to specific embodiments thereof, it will be apparent to one skilled in the art that various changes and modifications can be made therein without departing from the spirit and the scope thereof.

What is claimed is:

1. A method for electrolyzing hydrochloric acid in an electrolysis apparatus, comprising at least two electrolysis cells, each electrolysis cell having at least one anode, at least one cathode and at least one cation exchange membrane therebetween to define an anode compartment and a cathode compartment therein, and said method comprising the steps of (a) feeding hydrochloric acid aqueous solution as a starting material into the anode compartment of a first electrolysis cell and electrolyzing said hydrochloric acid aqueous solution therein, (b) feeding hydrochloric acid aqueous solution discharged from said anode compartment of said first electrolysis cell into the anode compartment of a second electrolysis cell and electrolyzing said hydrochloric acid aqueous solution therein, (c) feeding hydrochloric acid aqueous solution discharged from the anode compartment of the last electrolysis cell of said electrolysis apparatus into the cathode compartment of each of said electrolysis cells in said electrolysis apparatus, (d) and further, for any additional electrolysis cells present in addition to said first and said second electrolysis cells, subsequent to step (b) and prior to step (c), sequentially feeding hydrochloric acid aqueous solution discharged from the anode compartment of a preceding electrolysis cell into the anode compartment of a subsequent electrolysis cell and electrolyzing said hydrochloric acid aqueous solution therein, and (e) collecting chlorine gas generated in the anode compartments and hydrogen gas generated in the cathode compartments.

2. The method of claim 1, wherein the hydrochloric acid aqueous solution discharged from the anode compartment of the last electrolysis cell of said electrolysis apparatus is simultaneously divided and fed into the cathode compartment of each of the electrolysis cells of said electrolysis apparatus.

3. The method of claim 1, wherein the hydrochloric acid aqueous solution discharged from the anode compartment of the last electrolysis cell of said electrolysis apparatus is fed into the cathode compartment of the last electrolysis cell of said electrolysis apparatus, hydrochloric acid aqueous solution discharged from the cathode compartment of the last electrolysis cell of said electrolysis apparatus is fed into the cathode compartment of the immediately preceding electrolysis cell, and likewise, hydrochloric acid aqueous solution discharged from the cathode compartment of each electrolysis cell is then fed into the cathode compartment of the immediately preceding electrolysis cell.

* * * * *